US006055720A

United States Patent [19]

Finn et al.

[11] Patent Number: 6,055,720

[45] Date of Patent: May 2, 2000

[54] DEVICE AND METHOD FOR MANUFACTURING A COIL ARRANGEMENT

[76] Inventors: David Finn, König-Ludwig-Weg 24, Pfronten, D87459; Manfred Rietzler, Am Alsterberg 10, Marktoberdorf, D-87616, both of Germany

[21] Appl. No.: 08/894,097

[22] PCT Filed: Jan. 20, 1995

[86] PCT No.: PCT/DE95/00073

§ 371 Date: Jul. 21, 1997

§ 102(e) Date: Jul. 21, 1997

[87] PCT Pub. No.: WO96/22608

PCT Pub. Date: Jul. 25, 1996

[51] Int. Cl.[7] ..... H01F 7/06

[52] U.S. Cl. ..... 29/605; 242/118.4

[58] Field of Search ..... 242/118.4, 125, 242/125.2, 447.1; 29/605

[56] References Cited

U.S. PATENT DOCUMENTS

| | | | |
|---|---|---|---|
| 2,302,965 | 11/1942 | Lucia | 242/118.4 |
| 3,989,200 | 11/1976 | Bachi | 242/7.03 |
| 5,549,257 | 8/1996 | Sanda et al. | 242/580 |

FOREIGN PATENT DOCUMENTS

| | | | |
|---|---|---|---|
| 62-181412 | 8/1987 | Japan | H01F 41/06 |
| WO 91/00603 | 1/1991 | WIPO | H01F 41/06 |
| WO 92/15105 | 9/1992 | WIPO | H01F 41/04 |

*Primary Examiner*—David A. Scherbel
*Assistant Examiner*—Benjamin Halpern
*Attorney, Agent, or Firm*—Darby & Darby

[57] ABSTRACT

A device and method for manufacturing a coil arrangement (21) with a matrix support (11), a winding matrix (12) for receiving winding wire turns and at least two holding devices (13, 14) arranged on the matrix support (11) for holding winding wire end regions (26, 27), the winding matrix (12) and the matrix support (11) having a common axis of rotation (23), and the holding devices (13, 14) being arranged at the circumferential edge of the matrix support in such a manner that the winding wire guided by a wire conductor (24) beyond the circumferential edge in the direction of the rotational axis is guided through the holding devices and held therein.

9 Claims, 7 Drawing Sheets

DEVICE AND METHOD FOR MANUFACTURING A COIL ARRANGEMENT

FIELD OF THE INVENTION

The invention relates to a device for manufacturing a coil arrangement with a matrix support, a winding matrix for receiving winding wire turns and at least two holding devices arranged on the matrix support for holding winding wire end regions. Furthermore, the invention relates to a method for manufacturing a coil arrangement according to claims 19 and 20.

BACKGROUND OF THE INVENTION

A device of the above type is known from WO 91/00603. In the known device the matrix support, which is used for receiving the winding matrix, is constructed in the manner of a plate, and the holding devices are arranged to the left and right respectively of the winding matrix in the plane of the matrix support. In order to form a coil arrangement with two winding wire end regions, a winding device known as a flyer is firstly moved along a first translation axis from the first holding device to the winding matrix, and then in order to form the coil winding is rotated about the winding matrix and finally moved again in translatory fashion from the winding matrix to the second holding device. During the coil winding, the wire conductor is additionally moved along a second translation axis. At the end of the winding procedure, a winding wire end region extending radially from the winding matrix is formed in each case between the holding devices and the winding matrix. Since the holding devices are arranged in the plane of the matrix and either side thereof, only a diametral alignment of the winding wire end regions is possible using this known device.

On account of the unfavourable diametral alignment of the winding wire end regions extending from the winding matrix, it is necessary prior to the connection of said winding wire end regions with connection surfaces of a substrate, which can also be constructed as an electronic component such as a chip, to completely reorientate the winding wire end regions. Furthermore, the known device can only be used together with a flyer in order to manufacture a coil arrangement. In the winding method carried out using said known device, the winding wire is applied to the winding matrix by the flyer rotating about the fixed winding matrix. In this respect, the winding wire slides through the rotating wire conductor of the flyer and is deflected in constantly varying directions in relation to the wire supply direction. This results in dynamic bending stress to the winding wire, to which torsional stress is added as a result of the helical winding path on the winding matrix. In all, this results in a stressing of the winding wire during the winding procedure which can lead to variations in the wire cross section influencing the coil inductance or can even lead to a tearing of the winding wire.

A device for manufacturing a coil arrangement is known from U.S. Pat. No. 3,989,200 with a matrix support, a winding matrix comprising a winding core for receiving winding wire turns and at least two holding devices arranged on the matrix support for holding winding wire end regions, the winding matrix and the matrix support having a common axis of rotation. In the known device, at least one holding device is arranged directly adjacent the winding core on the matrix support, so that the winding wire end region formed between the holding device and the coil body is in close contact with the coil body.

OBJECT OF THE INVENTION

It is the object of the invention to provide a device and a method which allow for an orientation of the winding wire end regions which is favourable for the subsequent connection of winding wire end regions to connection surfaces of an electronic component, and the execution of a winding procedure with considerably reduced wire stressing.

SUMMARY OF THE INVENTION

In accordance with the invention, the winding matrix and the matrix support have a common axis of rotation. Consequently, a rotational movement of the matrix together with the matrix support is possible relative to a wire conductor, so that the winding wire is wound onto the winding matrix during the winding procedure. The associated wire stressing is considerably reduced as compared with the flyer method described above.

In addition, according to the invention the holding devices are arranged on the circumferential edge of the matrix support. As a result of this arrangement, it is possible in order to fix the winding wire end regions extending from the winding matrix to merely move the wire conductor away in the direction of the axis of rotation beyond the circumferential edge of the matrix support. In this respect, only one translatory axis of movement of the wire conductor is necessary both for carrying out the winding procedure, during which the wire conductor is reciprocated in translatory fashion, and for fixing the winding wire end regions in the holding devices. Thus, only two axes of movements are required as a whole when using the device according to the invention for manufacturing a coil arrangement, namely the axis of rotation of the matrix support and the translation axis of the wire conductor.

Finally, a further considerable advantage of the device according to the invention consists in that, owing to the arrangement of the holding devices at the circumferential edge of the matrix support, any orientation of the winding wire end regions is possible depending on the distance between the individual holding devices, so that an orientation of the winding wire end regions which is suitable for the subsequent connection with connection surfaces is already provided during the winding procedure.

In an advantageous embodiment, the holding devices are provided in a matrix support circumferential element arranged at the circumferential edge of a matrix support base. In contrast to the case of a one-part construction of the matrix support, it is thus possible to combine a standardised matrix support base with a matrix support circumferential element which can be individually adapted in its design to the desired coil arrangement.

In a further embodiment, at least one holding device can be provided at the circumferential edge of the matrix support, in a particularly advantageous manner at the circumferential edge of a matrix support circumferential element arranged on a matrix support base, and at least one further holding device can be arranged at the circumferential edge of a counter support.

It is also advantageous if the matrix support and/or the counter support is/are provided with a winding wire deflecting device, which aligns the winding wire end regions according to a given orientation in a transition region between a winding core and the holding devices.

According to a further advantageous embodiment of the device, the holding devices are constructed in such a manner that they are actuated by the wire conductor. In this manner, a correct timing of the holding function undertaken by the holding devices is ensured in each case, so that the holding function is provided after the passage or the wire conductor through the holding devices and not before, which could result in the passage of the wire conductor being blocked.

In a preferred embodiment of the holding devices, the latter are provided with clamping elements, which by overcoming an elastic restoring force can be moved apart by the wire conductor to allow for the passage of the winding wire. In addition to a secure clamping function, holding devices constructed in this manner also guarantee a high degree of operational reliability on account of their simple design.

A further possibility for the design of the holding devices consists in an active design in contrast to the above-described passive holding devices which are actuated by the wire conductor. Thus, the holding devices can also be pneumatically operated. An active design of the holding devices offers the advantage that there is no component stressing of the wire conductor and the latter is only used as a function of its position relative to the holding device in order to trigger an opening or closing signal for the holding device.

It has proved to be particularly expedient if a cutting device is associated with at least the holding device which is used for receiving the winding wire end region extending away from the winding matrix. The arrangement of a cutting device allows for the continuous winding of any number of coil arrangements on matrix supports arranged in succession, without the formation of wire bridges, which could result in undesirable wire wastage during a subsequent separation of the individual coil arrangements.

The advantageous design of the cutting device on the holding device per se makes it possible to use the movement carried out by the holding device for effecting the holding function in order to simultaneously cut the winding wire. This dispenses with the need for separate operating members for actuating the cutting device.

In a special embodiment, the matrix support circumferential element can be designed so as to be removable from the matrix support base. This allows for two quite substantial advantages. Firstly, the design of the matrix support circumferential element as removable from the matrix support base makes it possible to remove the finished coil arrangement from the matrix support base together with the matrix support circumferential element, the winding wire end regions being held in the holding devices arranged in the matrix support base circumferential element. Thus, the matrix support circumferential element acts as a sort of assembly frame, which allows the orientation of the winding wire end regions to be maintained during a subsequent application of said winding wire end regions to connection surfaces of an electronic component.

Secondly, the removable design of the matrix support circumferential element allows for the advantageous possibility of a simple replacement of the holding devices in respect of their relative arrangement and number. Thus, it is possible in one case, for example, to provide a matrix support circumferential element with two holding devices, which are arranged relative to one another in such a manner that the winding wire end regions of the coil arrangement extend parallel to one another. In another case, three holding devices can be provided, to allow for a coil arrangement with central tapping, for example.

If a device for the positioning accommodation of an electronic component provided with at least one connection surface is associated with the winding matrix or the matrix support in such a manner that an overlap region is formed between the connection surface and at least one winding wire end region when a component is arranged in the device, then a connection between the winding wire end regions and the connection surfaces of the component, such as a chip, can be carried out immediately following the actual winding procedure, so that the device can be particularly advantageously used to manufacture a transponder. Any type of welding process can be selected for the connection between the winding wire and the connection surfaces. Apart from the use of conventional welding methods such as thermocompressive, thermosonic or ultrasonic welding, a laser welding method has proved particularly advantageous, in which laser energy is applied to the connection site via a photoconductive fibre and a deformation of the bond formed by bonding wire is effected by pressure of the photoconductive fibre.

The winding matrix, which is used together with the matrix support, preferably comprises two disk-shaped side elements, which are detachably connected to a winding core. For the side elements, it has proved expedient in all cases for these to be made of temperature-stable plastics material, for example polytetrafluorethylene (PTFE), so that a thermal fixing of a coil winding made of enamelled winding wire can be carried out, without the side elements adhering to the coil winding. The winding matrix can also be formed solely by a winding core. The winding matrix can remain as a coil core in the winding coil following the winding procedure and can be made of plastics material or a ferrite core, for example.

The embodiment according to claim 14 offers the advantage of integrating an electronic component or an assembly in the winding coil.

Claims 16 and 17 relate to an advantageous combination of the winding matrix with a gripping and transporting device; both in the event that the winding coil is handled as an assembly unit together with a matrix support circumferential element, and in the event that the winding coil is handled directly whilst maintaining the relative position of the winding wire end regions.

The device according to the invention is particularly suitable for mass manufacture. In this respect, an arrangement is particularly advantageous in which a plurality of matrix supports are arranged with radially aligned axes of rotation on a common turntable, so that with a wire conductor displaceable radial to the axis of rotation of the turntable and with suitable turntable movement timing the matrix cores associated with the individual matrix supports can be continuously wound to form coil arrangements.

According to a first alternative, the method according to the invention for manufacturing a coil arrangement with a winding coil arranged on a substrate comprises the following method steps:

The manufacture of a winding coil on a winding device according to one or more of claims 1 to 18 with winding wire end regions which are aligned in their orientation relative to a coil body and are fixed in holding devices of a matrix support circumferential element;

The grasping and removal of an assembly unit formed by the matrix support circumferential element and the At winding coil from the winding device by means of a gripping and transporting device whilst maintaining the relative position of the winding wire end regions relative to the winding coil;

The application of the winding coil to the substrate whilst maintaining the relative position of the winding wire end regions relative to the winding coil, connection of the winding wire end regions to connection surfaces of the substrate and release of the winding wire end regions from the holding devices, preferably by cutting the winding wire end regions.

According to a further alternative, the method according to the invention for manufacturing a coil arrangement with a winding coil arranged on a substrate comprises the following method steps:

The manufacture of a winding coil on a winding device according to one or more of claims 1 to 18 with winding wire end regions which are aligned in their orientation relative to a coil body and are fixed in holding devices of a matrix support and/or counter support;

The grasping of the coil body and the winding wire end regions using a gripping and transporting device whilst maintaining the relative position of the winding wire end regions relative to the winding coil and release of the winding wire end regions from the holding devices, preferably by cutting the winding wire end regions;

The removal of the coil body and the winding wire end regions from the winding device using the gripping and transporting device whilst maintaining the relative position of the winding wire end regions relative to the winding coil;

The application of the winding coil to the substrate whilst maintaining the relative position of the winding wire end regions relative to the winding coil, connection of the winding wire end regions to connection surfaces of the substrate.

Embodiments of the device according to the invention are explained in further detail in the following with the aid of the drawings, in which:

DETAILED DESCRIPTION OF THE INVENTION

Figure 1:
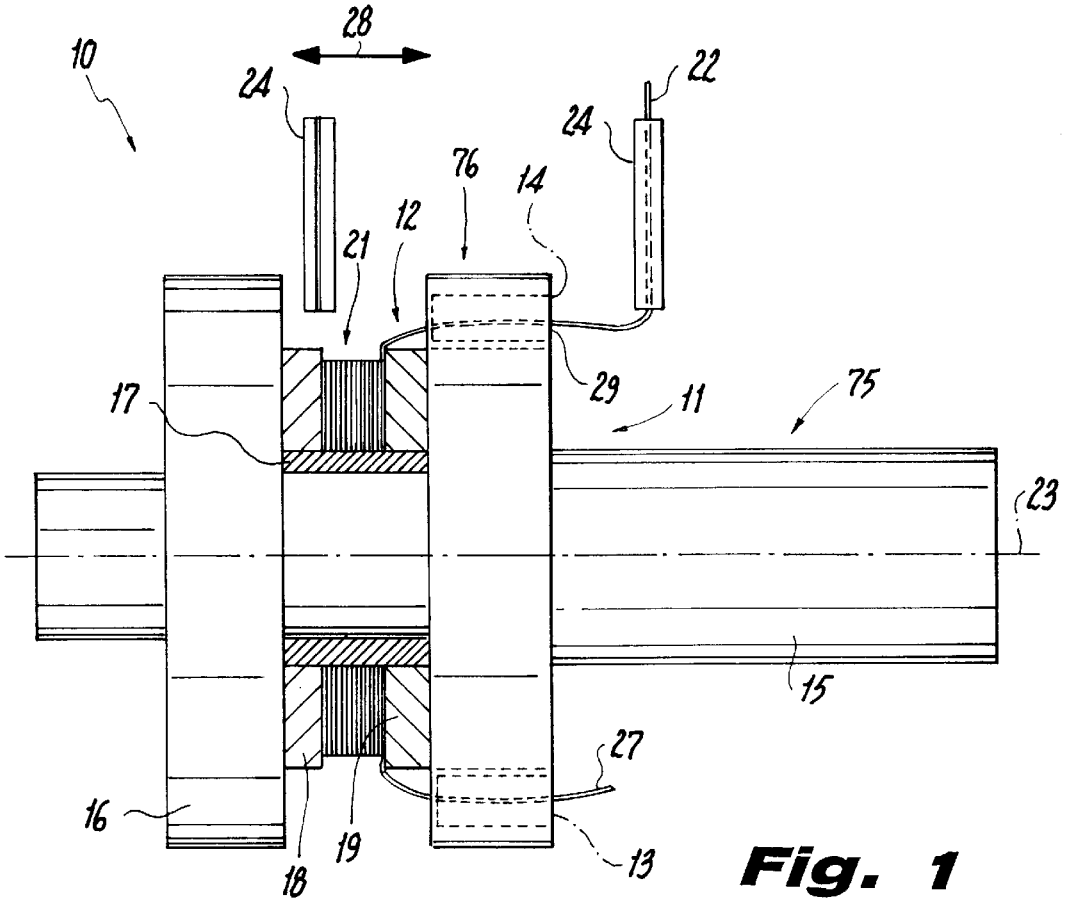
FIG. 1 is a side view of a first embodiment of a winding device for manufacturing a winding coil with a radial extension of the winding wire ends.

FIG. 1 shows a first embodiment of a winding device 10 with a matrix support 11, a winding matrix 12 and two holding devices 13, 14, which in the embodiment illustrated here are arranged diametrally opposite one another on the matrix support 11.

Figure 2:
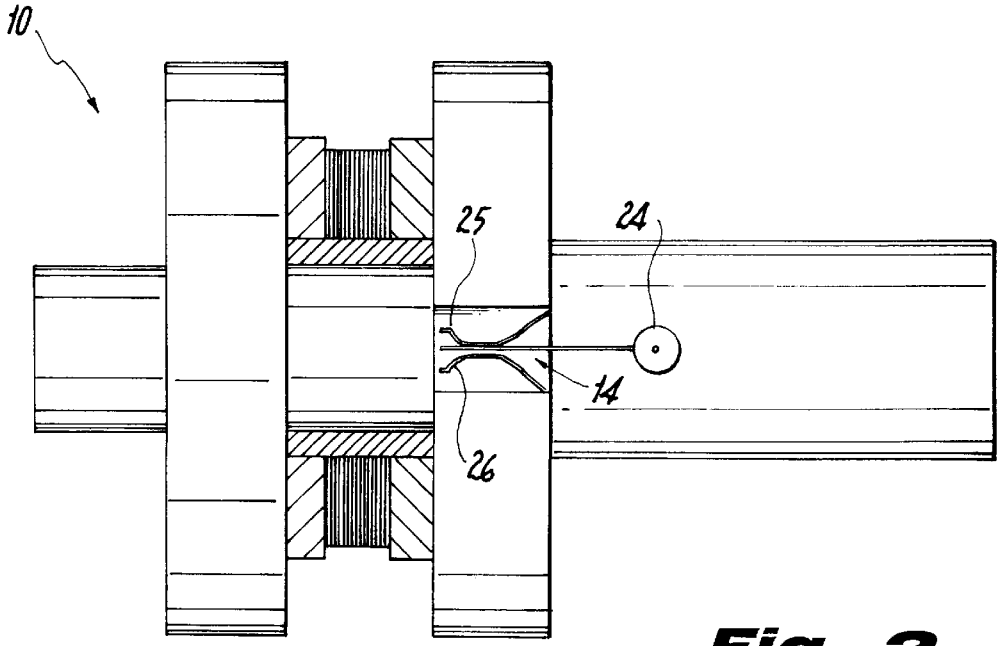
FIG. 2 is a plan view of the device illustrated in FIG. 1.

The holding devices 13, 14 are arranged at the circumferential edge of the matrix support 11, which can be integrally formed, or, as indicated by the dot-dash lines in FIGS. 1 and 2, can comprise a matrix support base 75 with a matrix support circumferential element 76 arranged thereon for receiving the holding devices 13, 14. The matrix support circumferential element 76 can be fixedly connected to the matrix support base 75 or can be detachable therefrom.

In the embodiment illustrated in FIG. 1, the matrix support 11 is provided with a drive shaft journal 15 and is used for receiving the winding matrix 12 and a counter support 16, which secures the winding matrix 12 on the matrix support 11.

In the embodiment illustrated in FIG. 1, the winding matrix 12 is constructed in three parts and comprises a tubular winding core 17 and two disk-shaped side plates 18, 19, which are non-rotatably connected to the winding core 17 and are each arranged at one end of the winding core in such a manner that they form an annular winding chamber 20 in this cast.

In FIG. 1, a fully formed winding coil 21 made of winding wire 22 is arranged in the winding chamber 20, a wire conductor 24 displaced in translatory fashion in the direction of the rotational axis 23 of the winding device 10 being used to form the winding coil 21. For a better clarification of the winding procedure, the wire conductor 24 is shown in two positions in FIG. 1, the left-hand position showing the wire conductor 24 in a phase during the coil winding and the right-hand position showing the wire conductor 24 following completion of the coil winding. This position of the wire conductor is also shown in FIG. 2.

At the start of the winding procedure not shown in further detail in its initial phase, the holding device 13 is located on the translation axis of the wire conductor 24 (like the holding device 14 in FIG. 2) and the wire conductor 24 is guided from the right through the holding device 13 which is constructed identical to the holding device 14 shown in FIG. 2. In this respect, the holding device 13 which comprises two spring limbs 25, 26 in this embodiment is expanded and opened by the wire conductor 24 constructed as a wire capillary tube, in order to close again after the passage of the wire conductor 24 on account of the elastic spring restoring forces. Consequently, the winding wire 22 is clamped with a first winding wire end region 27 in the holding device 13.

The wire conductor 24 is then reciprocated above the winding matrix 12, as shown by the left-hand position in FIG. 1, in the region of the winding chamber 20, as indicated by the double arrow 28. The translatory movement of the wire conductor 24 is superimposed with a rotational movement of the matrix support 11 set in rotation following the clamping of the winding wire end region 27 in the holding device 13. The winding matrix 12 also rotates, so that the winding wire 22 winds onto the winding core 17 of the winding matrix 12 to form the winding coil 21 illustrated in FIG. 1. The rotary movement of the matrix support 11 is carried out until, after reaching the desired number of turns on the winding core 17, the second holding device 14 lies in the position relative to the wire conductor 24 illustrated in FIGS. 1 and 2. The wire conductor 24 is then moved out of the winding region and through the spring limbs 25, 26 of the holding device 14, so that the winding wire is clamped with a second winding wire end region 29 between the spring limbs 25, 26 after the wire conductor 24 has passed through the holding device 14.

If necessary, the translation axis of the wire conductor can be supplemented by a Further axis, for example if the outer diameter of the winding matrix is larger than the diameter of the pitch circle on which the holding devices are arranged. In this manner, the wire conductor can be moved not only axial to the rotational axis of the matrix support but also radial thereto following clamping of the winding wire end region in a holding device, so that the wire conductor can be displaced beyond the circumferential edge of the winding matrix.

Following clamping in the holding device 14, the winding wire 22 can be cut to the right of the holding device 14 in FIG. 2 and the winding coil 21 can be removed from the winding matrix 12 after fixing of the coil winding. To this end, the winding wire end regions 27, 29 can be a withdrawn from the holding devices 13, 14, and the winding matrix 12 which is constructed in a number of parts in this embodiment is separated into its individual parts.

Figure 3:
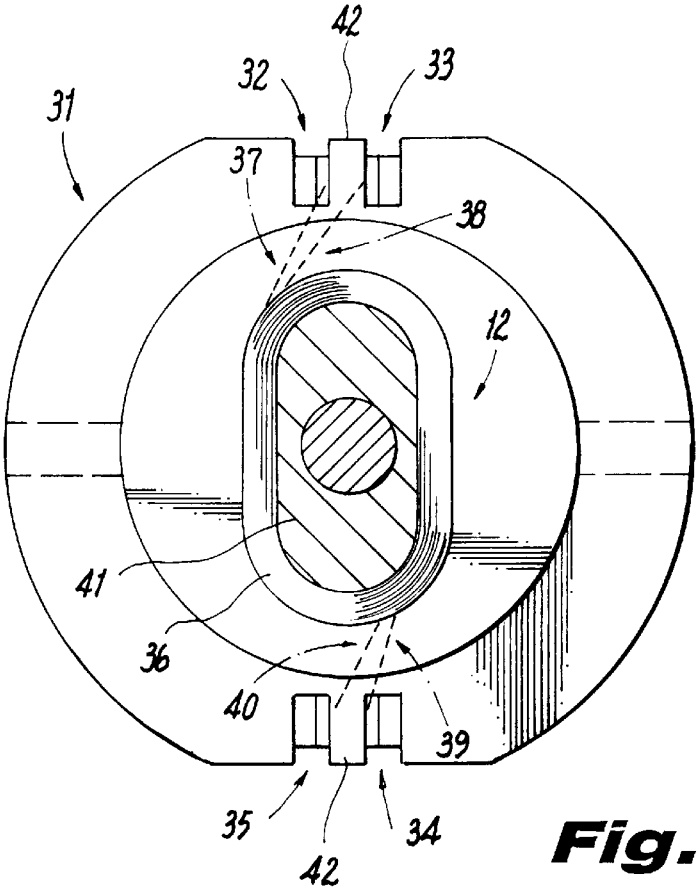
FIG. 3 is a front view of a further embodiment of a winding device for manufacturing a winding coil with radial extension of the winding wire ends.

FIG. 3 shows a winding device 30 with a matrix support circumferential element 31 modified relative to that in FIGS. 1 and 2 and provided with a total of four holding devices 32, 33, 34 and 35. The four holding devices allow for the formation of a winding coil 36 with four winding wire end regions 37, 38, 39, 40, which are arranged diametrally opposite one another in pairs. It can also be seen from FIG. 3 that with a suitable design of the winding core of the winding matrix 12, in this case as an oval winding core 41, any shape of coil can be formed.

Figure 4:
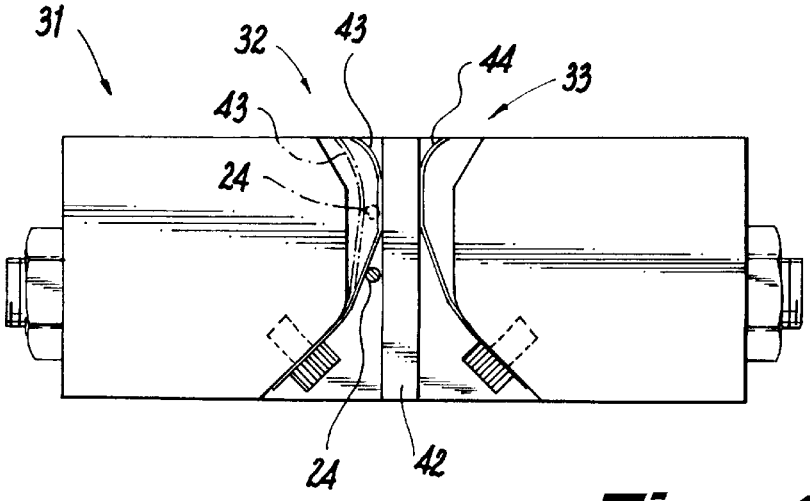
FIG. 4 is a plan view of the device illustrated in FIG. 3.

FIG. 4 is a plan view of the matrix support circumferential element 31 without the winding matrix 12 associated therewith. In this case, the holding devices 32, 33 separated by a material web 42 can be seen, which each comprise a spring limb 43, 44, which is screwed to the matrix support 31. Various deflections of the spring limb 43 are illustrated for the left-hand holding device 32, which are brought about by different positions of the wire conductor 24 as it slides through the holding device 32.

Figure 5:
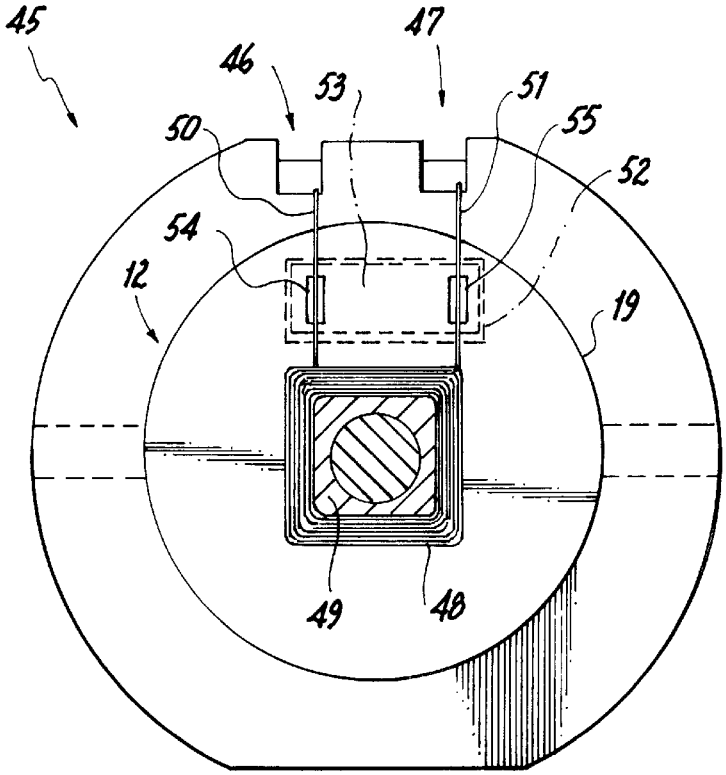
FIG. 5 is a front view of a further embodiment of a winding device for manufacturing a winding coil with radial extension of the winding wire end regions.

FIG. 5 shows a further variant of a matrix support circumferential element 45 with two holding devices 46, 47. In order to form a rectangular winding coil 48, a correspondingly shaped winding core 49 is provided. The dimensions of the winding core 49 as well as the thickness of the winding coil 48 and the distance between the holding devices 46, 47 are such that winding wire end regions 50, 51 lying substantially parallel to one another are formed. The above-mentioned dimensions can be adapted to one another in all cases so that a desired relative position of the winding wire end regions is always attained as in the case of the coil shapes described above by way of example. Thus, it is possible, if a position recorder 52 for an electronic component 53 is provided in the side plate 19 of the winding matrix 12 for example, to provide overlap regions for the subsequent connection of the winding wire end regions 50, 51 with connection surfaces 54, 55 of the component.

It is also clear from the illustration according to FIG. 5 how, in cases where the matrix support circumferential element 45 is constructed so as to be detachable from the matrix support base, the matrix support circumferential element 45 can be used as an assembly frame of an assembly unit formed by the matrix support circumferential element and the winding coil. If, as shown in FIG. 3, more than two winding wire end regions are provided, the winding coil can be precisely fixed in its position in the matrix support circumferential element. A coil arranged in this manner can be fitted together with the matrix support circumferential element onto a contact support, such as a flexiprint, in order to firstly connect the winding wire end regions to contacts and then to release the connection with the holding devices. Instead of providing a fixing of the winding coil in the matrix support circumferential element by means of the aligned winding wire end regions, it is also possible, as will be described in further detail below, to effect a securing by means of a correspondingly designed gripping and transporting device.

Figure 6:
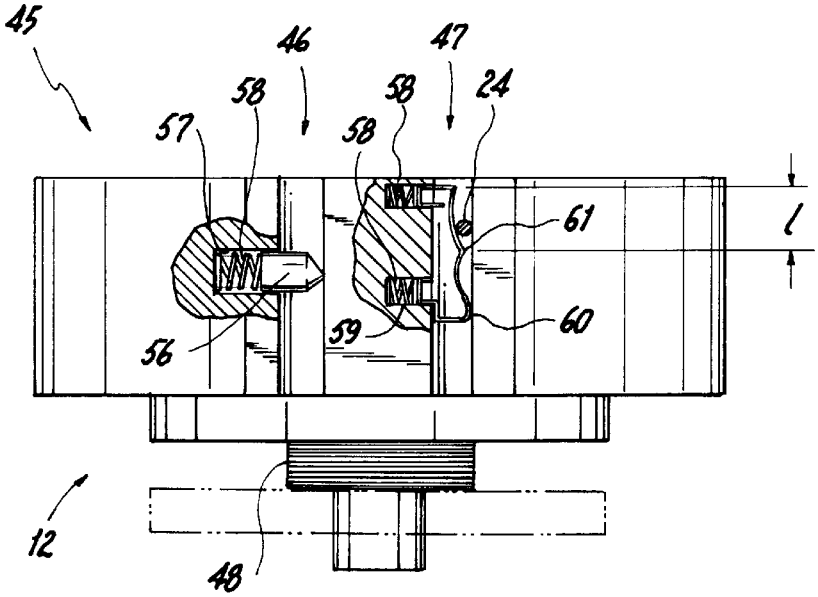
FIG. 6 is a plan view of the device illustrated in FIG. 5.

FIG. 6, in a plan view of the matrix support circumferential element 45, shows the holding devices 46, 47 in partial section. The holding device 46, which clamps the winding wire end region 50 formed at the start of the winding procedure, is provided in this case with a clamping element 56, which is supported relative to a spring 58 accommodated in a bore 57. The bore 57 is simultaneously used for guiding the clamping element 56. Instead of providing the spring restoring force of the spring 58 in order to generate the clamping effect, it is also possible to provide an active operating member for generating the clamping effect, for example a pneumatic cylinder, which acts upon the clamping element 56 and forces the latter against a material web 77. Instead of effecting the opening of the holding device by the wire conductor 24 which is guided through and the closure of the holding device by the restoring force of the spring 58, an operating signal could also be used, which acts upon the pneumatic cylinder and is triggered by an inductive proximity switch as a function of the position of the wire conductor relative to the holding device.

In the illustrated embodiment, the further holding device 47 is also provided with springs 58 for generating the clamping effect. In contrast to the holding device 46, the holding device 47 is provided with a clamping element 59, which in addition to a clamping edge 60 comprises a cutting edge 61 for cutting the winding wire 22.

As is clear from the illustration of the wire conductor 24 during its passage through the holding device 47, the cutting function is carried out when the wire conductor 24 leaves the region of the holding device 47 after completion of the coil 48. As a result of an increasing inclined position of the clamping element 59 as the wire conductor 24 approaches the end of the clamping element 59 remote from the coil 48, a clamping of the winding wire 22 is firstly effected by the clamping edge 60. When the wire conductor 24 leaves the region of the holding device 47, the cutting edge 61, as a result of the spring force of the rear spring 58, snaps against an abutment face 78 of the matrix support circumferential element 45, so that the cutting of the winding wire 22 is effected. The length of the excess wire projecting from wire conductor 24 following cutting is defined by the distance 1 of the cutting edge 61 from the rear edge of the clamping element 59. This distance is dimensioned in such a manner that the winding wire excess projecting from the wire conductor 24 is securely held in the first holding device of the following matrix support for the subsequent winding of a further coil.

Figure 7:
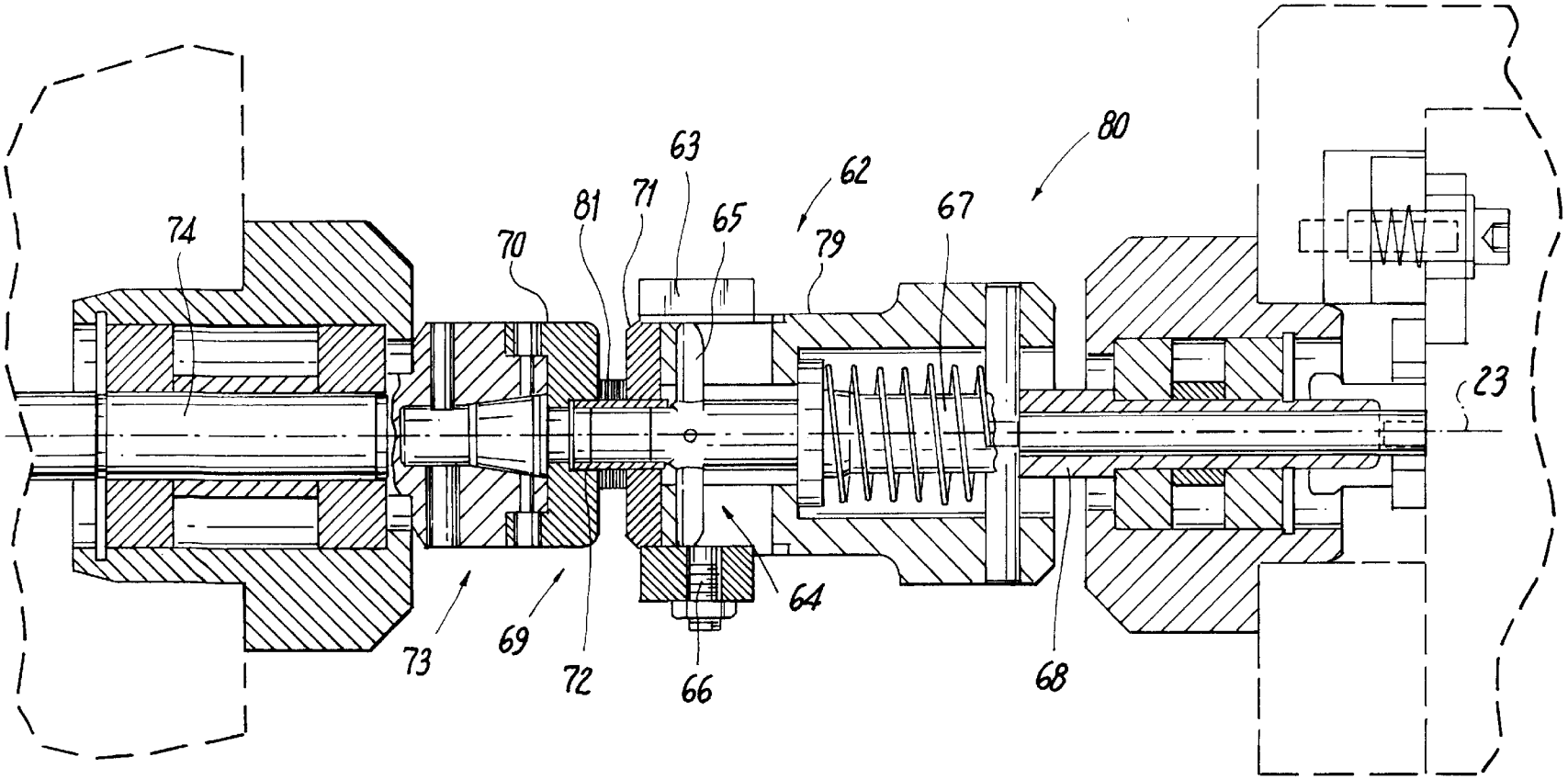
FIG. 7 is a section through a further variant of a winding device for manufacturing a winding coil with radial extension of the winding wire ends, the device being fitted in a drive device.

FIG. 7 shows a matrix support 62 arranged in a drive device 80 with a matrix body base 79, which is provided with a matrix body circumferential element 63 which is removable from the matrix body base 79 and comprises holding devices, not shown in further detail here, which can be arranged as desired. The matrix support circumferential element 63 is secured to the matrix support base 79 via a spring-supported pawl device 64. This comprises a locking rod 65 which is arranged transversely to the rotational axis 23 and behind which spring-supported pressure bolts 66 engage. The locking rod 65 can be displaced together with a spring-supported engaging shaft 67 relative to a drive shaft 68 non-rotationally connected to said engagement shaft 67.

Arranged on the end facing the matrix support 62 is a winding matrix 69 with two side plates 70, 71 and a winding core 72. The winding core 72 is non-rotatably connected with the engagement shaft 67. Finally, the side plate 70 of the winding matrix 69 remote from the matrix support 62 is connected via a coupling element 73 to a support shaft 74 in order to prevent an overhung mount of the matrix support 62.

The arrangement illustrated in FIG. 7 allows for a particularly simple and rapid removal of a fully wound winding coil 81 from the winding device. To this end, the winding core 72 is engaged by means of the engaging shaft 67 in the matrix support 62, so that the winding core releases from the side plate 70 and after release of the winding wire end regions, not shown, by the holding devices of the matrix support circumferential element 63, the winding coil 81 drops down from the winding device.

Figure 8:
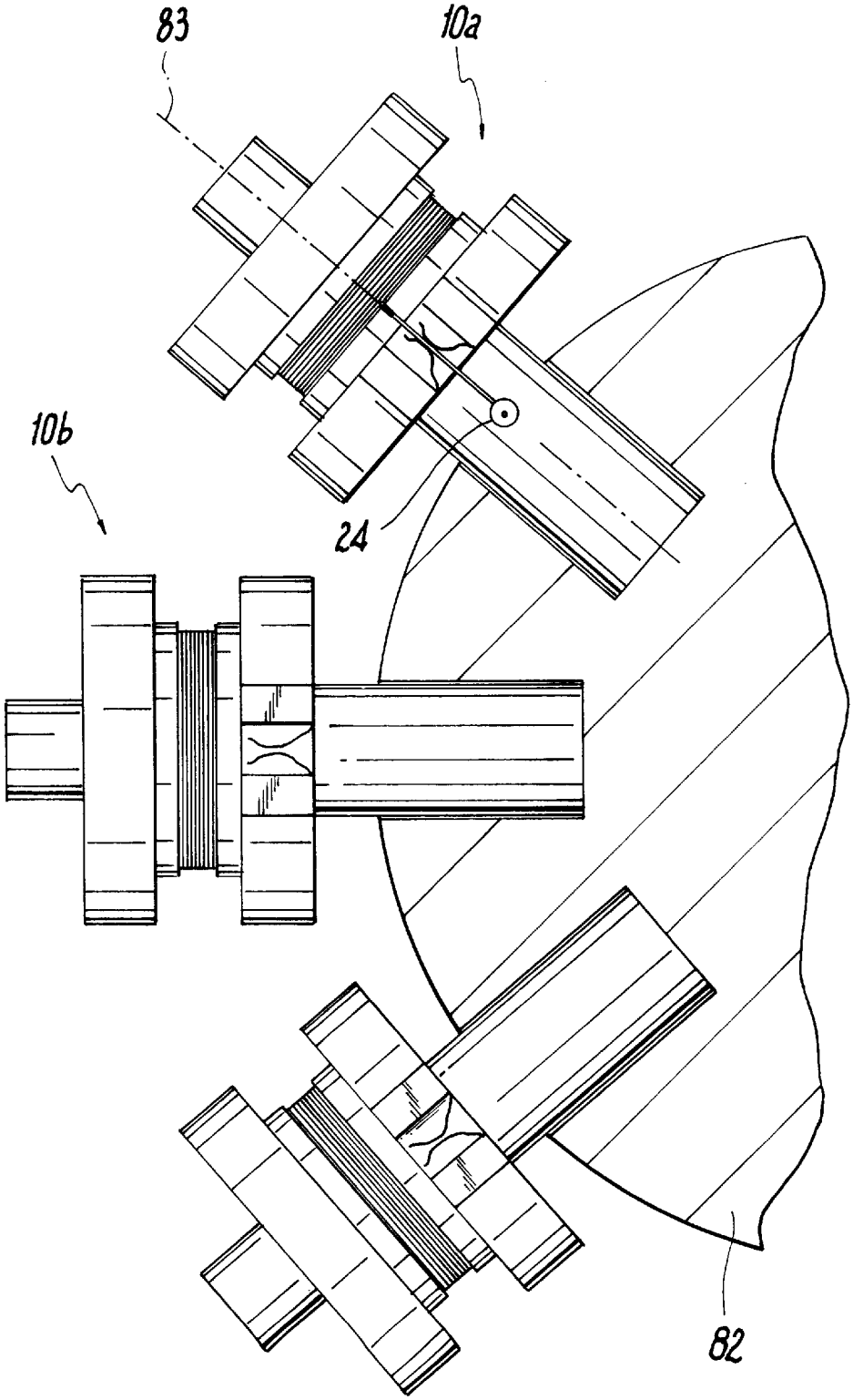
FIG. 8 shows the embodiment of the winding device illustrated in FIG. 2 in a multiple arrangement on a turntable.

The multiple arrangement of winding devices 10 on a turntable 82 as shown in FIG. 8 allows for continuous coil manufacture. In this respect, the wire conductor 24 is constantly moved along the same translation axis 83. After completion of a coil on a winding device 10*a* illustrated in the upper position in FIG. 8, the turntable 82 is advanced by one turntable graduation, so that the next coil can be wound on the winding device 10*b* pivoted with its rotational axis onto the translation axis 83 of the wire conductor 24.

Figure 9:
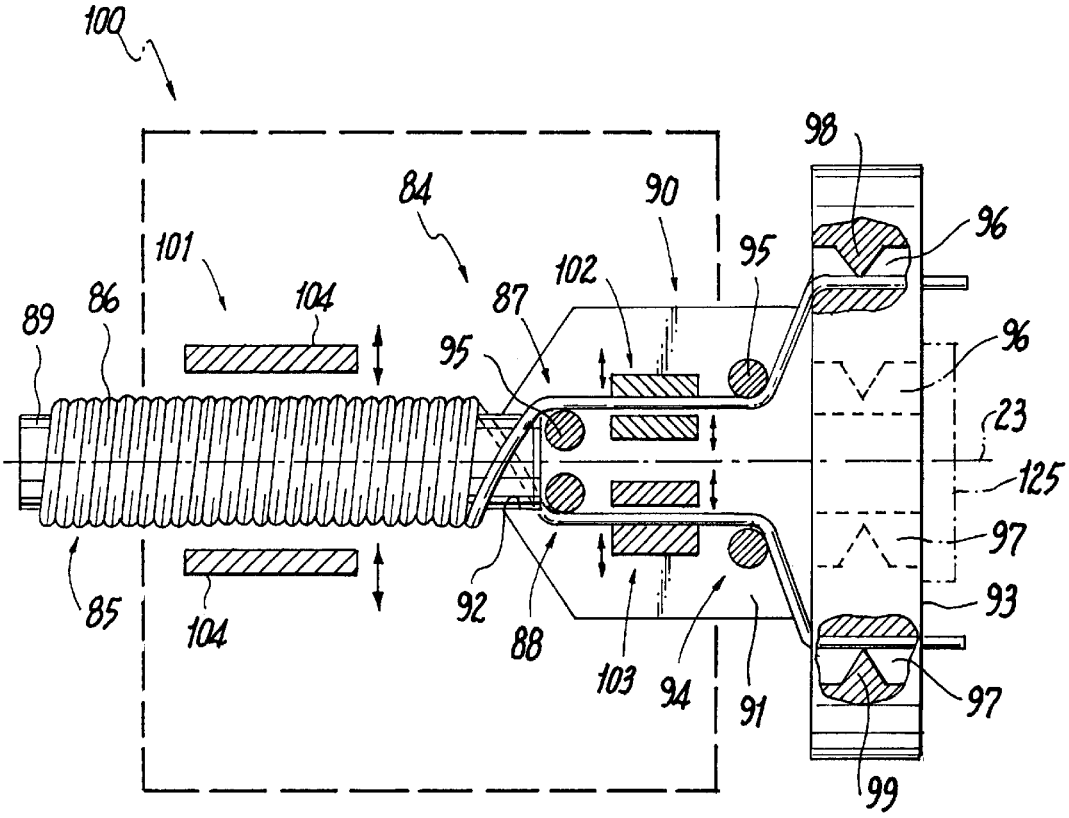
FIG. 9 shows an embodiment of a winding device for manufacturing a winding coil with axial extension of the winding wire ends showing a wire deflecting device and a gripping and transporting device.

FIG. 9 shows a winding device 84 for manufacturing a winding coil 85 with winding wire end regions 87, 88 extending axially from a coil body 86. In the embodiment illustrated here, the winding matrix merely comprises a winding core 89, which can be constructed as a ferrite core. The winding device comprises a matrix support 90, which rotates about the rotational axis 23 to produce a winding coil, for example in the same manner as the matrix support illustrated in FIG. 1. The matrix support 90 is provided on one side with a flattened section 91 which is aligned axially parallel to the rotational axis in this case and which extends from a winding core receiving recess 92 to a circumferential edge 93 of the matrix support 90 constructed in this case as a collar.

Arranged on the flattened section 91 is a wire deflecting device 94 with four deflecting rods 95, two deflecting rods being associated in each case with a winding wire end region 87, 88 and allowing for an alignment of the winding wire end regions 87, 88 independent of the circumferential position of holding devices 96, 97 provided in this case with clamping elements 98, 99 as holding members. An arrangement of the holding devices 96, 97, which could replace the wire deflecting device in its function with essentially the same alignment of the winding wire end regions, is shown in broken lines in FIG. 9.

The winding procedure for manufacturing the winding coil 85 illustrated in FIG. 9 is effected in the same manner as the winding procedure described with reference to FIG. 1. In cases where the wire deflecting device 94 is provided, the required relative movement of the wire conductor, not shown in further detail, can be effected via a double-axis wire conductor movement or a single-axis wire conductor movement which corresponds in its result and is superimposed with a corresponding rotary angle adjustment of the matrix support 90 relative to the rotational axis 23.

In addition, FIG. 9 shows a gripping and transporting device 100, which is provided with three grippers 101, 102, 103, which each comprise two gripping jaws 104 in the illustrated embodiment. In contrast to the illustration in FIG. 9, the gripping function provided by the grippers can also be effected not by "embracing" gripping but also by a suction gripper or a magnetic gripper. All that is important is the fact that the coil body 86 and the winding wire end regions 87, 88 are grasped in each case so that they are fixed in their relative position and, without changing this practically "frozen" relative arrangement following grasping by the gripping and transporting device 100, can be removed by said device from the winding device 84 and transported to an application point as described in further detail below. In order to ensure the above-mentioned freezing of the relative position without changes as a result of the gripping forces exerted by the grippers, in particular the grippers 102, 103 grasping the winding wire end regions 87, 88 can be constructed, for example, by a floating arrangement of the gripping jaws 104, in such a manner that they automatically align themselves with the aligned winding wire end regions during the gripping procedure.

In cases where the matrix support 90 illustrated in FIG. 9 is not integrally formed, but the circumferential edge 93 is constructed as a detachable matrix support circumferential element, in a modified configuration the gripping and transporting device 100 can comprise, instead of the grippers 102, 103 grasping the winding wire end regions 87, 88 and in addition to the gripper 101 grasping the coil body 86, a gripper 125, which is shown in dot-dash lines in FIG. 9 and grasps the matrix support circumferential element.

Figure 10:
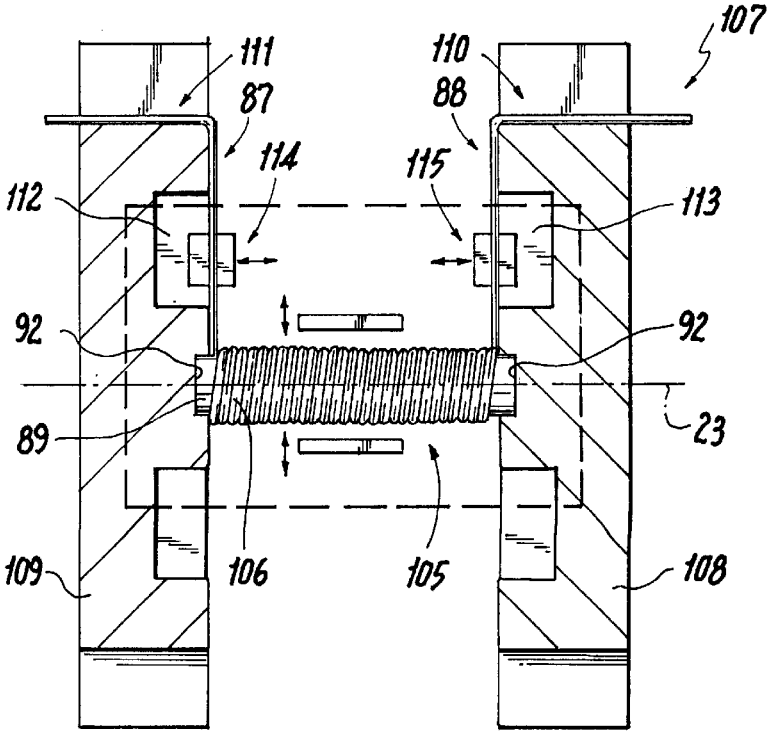
FIG. 10 shows an embodiment of a winding wire device for manufacturing a winding coil with radial extension of the winding wire ends showing a gripping and transporting device.

FIG. 10 shows a winding coil 105 with a coil body 106 and with radial extension of the winding wire end regions 87, 88, which are axially offset relative to one another. A winding coil 105 of this type can be manufactured in a winding device 107 similar to the winding device 10 illustrated in FIG. 1. In contrast to the winding device 10, the winding matrix comprises only a winding core 89 as in the preceding embodiment. This is accommodated in winding core receiving recesses 92 between a matrix support 108 and a counter support 109. In this case, the matrix support 108 is integrally formed, but can also be formed by a matrix support base with a matrix support circumferential element arranged thereon. Similar to the embodiment illustrated in FIG. 1, the winding wire end regions 87, 88 are received in holding devices 110, 111, although the holding device 110 is provided on the matrix support 108 and the holding device 111 on the counter support 109. As an alternative to the counter support 109, which rotates together with the matrix support 108 during the winding procedure, a stationary support, not illustrated in further detail, can be provided with the holding device 111.

The matrix support 108 and counter support 109 are provided on their opposing surfaces with at least one gripping duct 112, 113 in each case, which allow for the access of grippers 114, 115 of a gripping and transporting device 116, already described in detail in respect of its function with reference to FIG. 9, to the aligned winding wire end regions 87, 88. In order to prevent the formation of a mass imbalance during rotation of the winding device 107, balancing ducts 117, 118 corresponding to the gripping ducts are provided symmetrical to the rotational axis 23.

Figure 11:
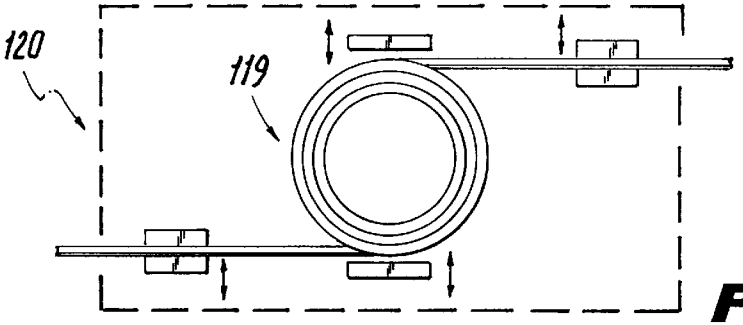
FIG. 11 shows a further embodiment of a winding coil with radial extension of the winding wire ends and showing a gripping and transporting device.

As a further embodiment, FIG. 11 shows an annular winding coil 119, which is constructed as an air coil and can also be manufactured using the winding device 107 illustrated in FIG. 10, in an arrangement of the matrix support 108 and counter support 109 offset through 180° relative to one another in relation to the rotational axis 23. FIG. 11 also shows a corresponding configuration of a gripping and transporting device 120.

Figure 12:
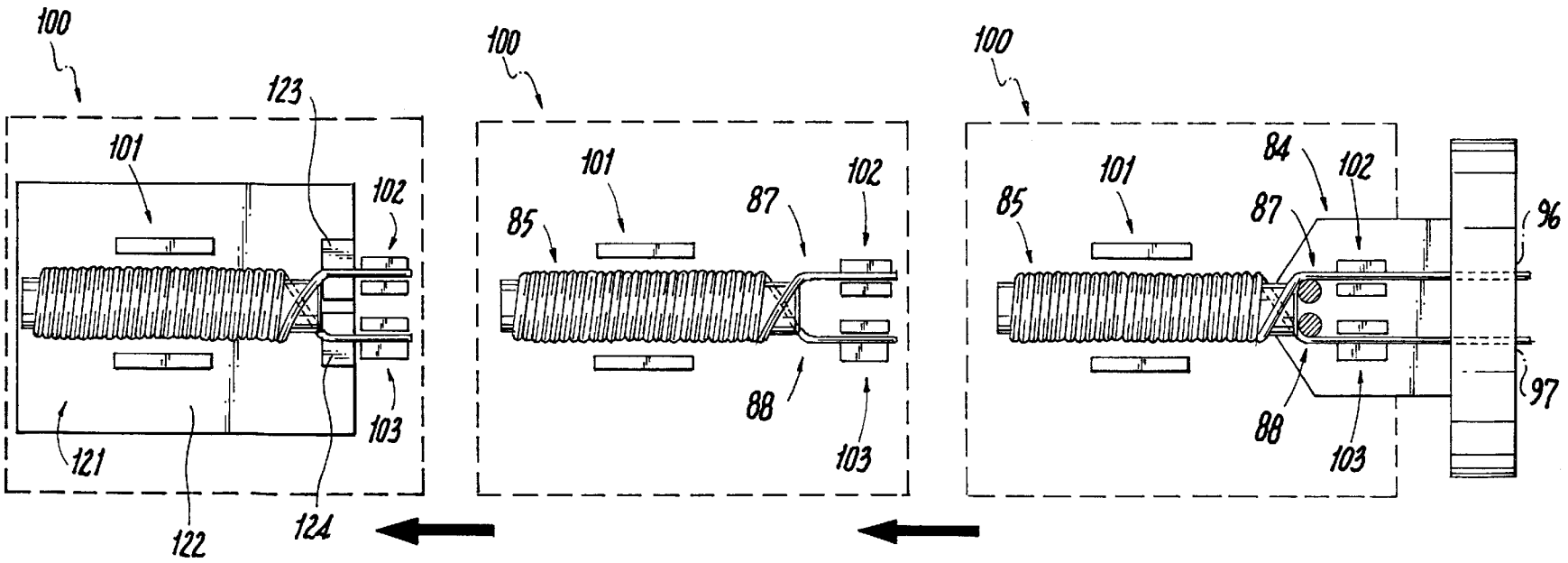
FIG. 12 is a schematic illustration of a possible variant of a method for manufacturing a coil arrangement with a winding coil arranged on a substrate.

FIG. 12 shows the manufacture of a coil arrangement 121 by way of example of the manufacture and subsequent application of the winding coil 85 manufactured in the winding device 84. The grasping of the winding coil 85 by means of the gripping and transporting device 100 has already been explained in detail with reference to FIG. 9. The removal of the winding coil 85 together with the winding wire end regions 87, 88 unchanged in their relative position to one another and to the winding coil 85 is effected after their release from the holding devices 96, 97. The release can be effected by means of an opening of the holding devices in the case of active holding devices, or by means of a cutting device not shown in detail, which cuts the winding wire end regions 87, 88. In the case of an arrangement of the holding devices on a matrix support circumferential element, the latter can be removed together with the winding wire end regions 87, 88 by the gripping and transporting device 100.

The gripping and transporting device 100 transports the winding coil 85 to a substrate 122, to which the winding coil 85 is to be applied. This substrate can be a lead frame, for example, provided with connection surfaces 123, 124. It could also be a chip, whose connection surfaces are to be contacted with the winding wire end regions of the winding coil 85.

In the embodiment illustrated in FIG. 12, the winding coil 85 is positioned with its winding wire end regions above the substrate 122 in such a manner that an overlap is provided between the connection surfaces 123, 124 of the substrate 122 and the winding wire end regions 87, 88 for subsequent contacting. In cases where the gripping and transporting device 100 is provided with a connection device, not shown in further detail here, for example a thermode or a laser connecting device provided with a photoconductive fibre, the contacting can also be effected immediately with the gripping and transporting device 100 in the position illustrated in FIG. 12.

We claim:

1. A device for manufacturing a coil arrangement onto a matrix support comprising:

a winding matrix with a winding core for receiving winding wire turns, the winding matrix and the matrix support having a common axis of rotation;

at least two holding devices for holding the wire away from the winding matrix, the holding devices being arranged at a circumferential edge of the matrix support;

a reciprocating wire conductor for guiding the wire on a path between a matrix position adjacent to the winding matrix and a remote position away from the winding matrix, the wire conductor passing through the holding devices.

2. The device according to claim 1, wherein the at least two holding devices are actuatable and the reciprocating wire conductor is designed to actuate at least two holding devices.

3. The device according to claim 2, wherein the at least two holding devices comprise two spring elements arranged such as to clamp the wire when actuated by the passing through wire conductor.

4. The device according to claim 1, wherein the two holding devices comprise actuating means for holding the wire.

5. The device according to claim 4, wherein the actuating means are pneumatic means.

6. The device according to claim 1, further comprising a cutting device associated with at least one holding device for cutting the wire.

7. The device according to claim 6, wherein the cutting device is arranged such that the cutting of the wire is effected upon the wire conductor passing through at least one holding device.

8. The device according to claim 1, wherein the winding matrix comprises the winding core and two disk-shaped side elements, the two disk-shaped side elements being detachable from the winding core.

9. The device for manufacturing a plurality of coil arrangements onto matrix supports, each matrix support comprising:

a winding matrix with a winding core for receiving winding wire turns, the winding matrix and the matrix support having a common axis of rotation;

at least two holding devices for holding the wire away from the winding matrix, the holding devices being arranged at a circumferential edge of the matrix support, wherein each of the matrix supports is radially aligned on a common turntable; and a reciprocating wire conductor for guiding the wire on a path between a matrix position adjacent to the winding matrix and a remote position away from the winding matrix passing through the holding devices, the wire conductor being movable radially to the rotational axis of the turntable correspondingly timed with a turntable movement such as to wind winding cores associated with the individual matrix supports in order to form coil arrangements.

* * * * *